United States Patent [19]

Lee

[11] Patent Number: 4,561,902

[45] Date of Patent: Dec. 31, 1985

[54] ULTRASONIC METHOD AND APPARATUS FOR CLEANING TRANSMISSIONS

[76] Inventor: Cecil D. Lee, 1809 E. 11th, Tulsa, Okla. 74104

[21] Appl. No.: 662,525

[22] Filed: Oct. 18, 1984

Related U.S. Application Data

[63] Continuation of Ser. No. 471,890, Mar. 3, 1983, abandoned.

[51] Int. Cl.[4] ..... B08B 3/12

[52] U.S. Cl. ..... 134/1; 134/18; 134/33; 134/57 R; 134/105; 134/147; 134/157; 134/169 A; 134/170; 134/184

[58] Field of Search ..... 134/1, 18, 33, 105, 134/169 A, 170, 184, 147, 157, 57 R

[56] References Cited

U.S. PATENT DOCUMENTS

| | | | |
|---|---|---|---|
| 2,702,260 | 2/1955 | Massa | 134/157 X |
| 2,828,231 | 3/1958 | Henry | 134/1 |
| 2,888,939 | 6/1959 | Nitsche | 134/1 X |
| 3,096,774 | 7/1963 | Rand | 134/1 X |
| 3,302,655 | 2/1967 | Sasaki et al. | 134/1 X |
| 3,557,807 | 1/1971 | Schipke | 134/33 X |
| 3,990,906 | 11/1976 | Johnston et al. | 134/1 |
| 4,375,819 | 3/1983 | Kyatt | 134/105 |

FOREIGN PATENT DOCUMENTS

| | | | |
|---|---|---|---|
| 825203 | 4/1981 | U.S.S.R. | 134/1 |

OTHER PUBLICATIONS

*Anti-Corrosion,* "Ultrasonic Cleaning Techniques", Sep. 1974, pp. 17-21.

*Primary Examiner*—Marc L. Caroff
*Attorney, Agent, or Firm*—Head, Johnson & Stevenson

[57] ABSTRACT

Apparatus and method for the ultrasonic cleaning of transmissions, such as automotive transmissions and the like, and which comprises a housing or tank for receiving cleaning liquid therein, a turntable mounted within the housing for supporting the transmission within the cleaning liquid, at least one transducer secured to the housing for impressing ultrasonic energy on the cleaning liquid, heating elements secured to the tank for heating of the cleaning liquid, the transmission being rotatable simultaneously with the turntable for passing the entire outer periphery or external surfaces of the transmission across the face of the transducer within specified or selected spacing therebetween whereby the transmission is cleaned both interiorly and exteriorly without the necessity of disassembly and ultimate reassembly of the transmission during the cleaning operation.

10 Claims, 4 Drawing Figures

ULTRASONIC METHOD AND APPARATUS FOR CLEANING TRANSMISSIONS

This application is a continuation of application Ser. No. 471,890, filed Mar. 3, 1983 and now abandoned.

BACKGROUND OF THE INVENTION

1. Field of the Invention

This invention relates to improvements in transmission cleaning methods and means and more particularly, but not by way of limitation, to an ultrasonic method and apparatus for cleaning transmissions.

2. Description of the Prior Art

In the repair of an automotive transmission, or the like, it is normally necessary to clean the transmission prior to the initiation of any repair operation which may be required. The most prevalent method in use today for the cleaning of automotive transmissions, and the like, comprises the use of a high spraying apparatus wherein fluid is directed to the exterior surfaces of the transmission under high pressure conditions for blasting the exposed surfaces of the transmission for at least a superficial cleaning thereof. Subsequent to the cleaning of the exterior portions of the transmission, the entire transmission is then usually disassembled and the individual components or parts of the transmission are placed in a chemical solution or a chemical bath for cleaning thereof. This disassembly procedure is necessary because the high pressure fluid cleaning of the exterior of the transmission does not clean the internal components thereof. Of course, subsequent to the application of the chemical solution to the individual transmission parts, the transmission must be reassembled for restoring the transmission to a usable condition for either repair or installation in an automobile, or the like. It will be readily apparent that the disassembly and reassembly of the transmission is expensive and time consuming, and greatly increases the overall cost of the transmission repair operation.

SUMMARY OF THE INVENTION

The present invention contemplates a novel ultrasonic method and means for cleaning transmissions in a manner which overcomes the foregoing disadvantages. The novel apparatus comprises a housing or tank having a rotatable support means or turntable mounted therein for supporting the transmission within a suitable cleaning liquid. A transducer means is suitably mounted on the housing for impressing ultrasonic energy on the cleaning liquid for cavitation thereof, as is well known, and the transmission supported within the cleaning liquid is cleaned both interiorly and exteriorly by the application of the ultrasonic energy to the cleaning liquid. In order to completely clean the transmission in a one-step operation, it is merely necessary to initially drain all of the oil from the transmission in any well known or suitable manner and place the entire assembled transmission in the tank or housing in such a manner that the transmission is immersed in the cleaning liquid. Ultrasonic energy is then impressed on the cleaning liquid in such a manner that the ultrasonic energy cavitates the cleaning liquid to effect a simultaneous cleaning of the exterior and interior of the submerged transmission. The cleaned transmission may be removed from the tank and either repaired as required or installed at the desired operational location therefor, whereupon the cleaned and repaired transmission may be restored to normal use. It is to be noted that a suitable basket may be utilized, if desired, whereby a plurality of transmission heads may be immersed in the cleaning liquid at one time for effecting a simultaneous cleaning of the several transmissions.

Of course, ultrasonic cleaning by means of impressing ultrasonic energy on a suitable cleaning liquid for cavitatation thereof and immersing the article to be cleaned in the cavitated liquid is old and well known. However, the application of ultrasonic energy in the cleaning of transmissions has not been previously practiced in the industry. The development of the apparatus of the present invention provides great improvement in the overall cleaning results, and coupled with the elimination of the necessity of disassembly of the transmission for the cleaning thereof has provided a vast advancement in the transmission cleaning art. The turn table supporting the transmission in the cavitated cleaning liquid assures that each and every portion of the exterior of the transmission will be passed over or moved across the fact of the transducer means, thus providing an efficient cleaning of the entire transmission with the use of a single transducer. This greatly reduces the overall cost of the cleaning equipment, since much of the expense of the apparatus resides in the transducer itself. In addition, a drain means is provided in the lower portion of the housing or tank, the drain means being in communication with suitable filter pumping means for circulation of fluid across the bottom of the housing or tank to remove any sludge which may accumulate in the tank during the cleaning operation. The cleaning liquid is preferably heated to a temperature of approximately 100° F. to 140° F. and the cleaning liquid may be any suitable mild liquid which is not injurious to the hands or skin of the operator of the apparatus. The novel method and means for ultrasonic cleaning of transmissions is simple and efficient in operation and economical and durable in construction.

DETAILED DESCRIPTION OF THE PREFERRED EMBODIMENT

Figure 2:
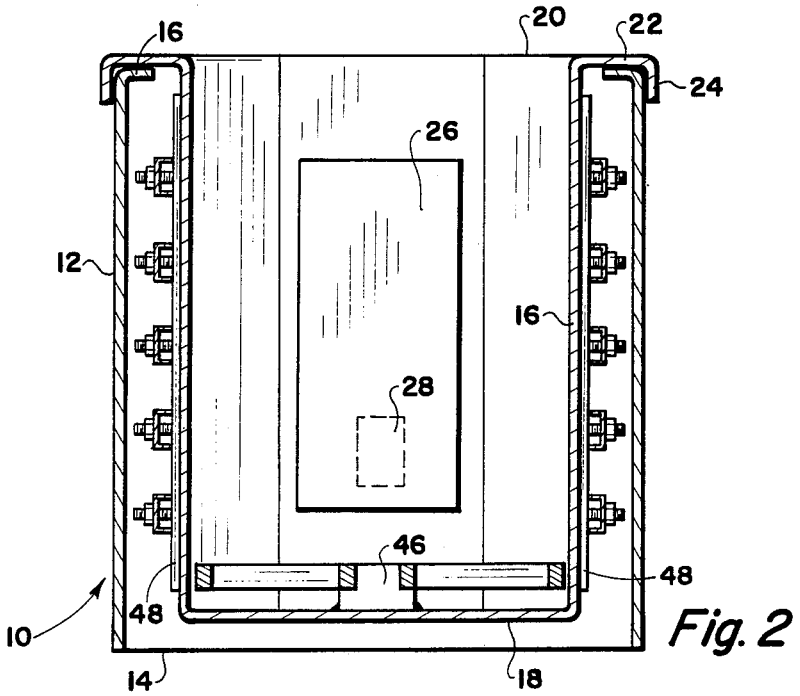
FIG. 2 is a view taken on line 2—2 of FIG. 1.

Referring to the drawings in detail, reference character 10 generally indicates a transmission cleaning apparatus comprising an outer housing or tank 12 having one end 14 thereof open and the opposite end thereof provided with an inwardly directed circumferential flange 16 forming an annular shoulder. An inner housing or tank 18 is concentrically disposed within the housing 12 and has one end closed by a bottom plate 18 as particularly shown in FIG. 2. The opposite end of the housing 16 is open as shown at 20, and is provided with an outwardly extending circumferential flange 22 having a reverse cylindrical flange 24 provided around the outer periphery thereof. The shoulder or flange 22 is adapted to engage the flange 16 for supporting the housing 16 within the housing 12, and the flange 24 is adapted to engage the outer periphery of the housing 12 for facilitating the alignment between the inner and outer housings 12 and 16.

A suitable transducer means 26 is secured to the inner surface of the housing 16 in any well known manner (not shown) and is preferably an immersible transducer of the type manufactured and sold by Branson Cleaning Equipment Company, Parrott Drive, Shelton, Conn. The usual junction box 28 normally provided with the transducer means 26 may be suitably mounted on the outer surface of the housing 16 for operable connection with an ultrasonic generator 30 of the type also manufactured and sold by Branson Cleaning Equipment Company. Of course, suitable apertures (not shown) may be provided in the housing 12 for receiving the conduit means 32 therethrough which operably connects the junction box means 28 with the ultrasonic generator means 30. In addition, suitable conduit means 34 provides communication between the junction box 28 and a suitable source of electric power (not shown) and a suitable aperture (not shown) is preferably provided in the housing 12 for receiving the conduit means 34 therethrough, as is well known.

A turntable or rotatable support means generally indicated at 36 is disposed within the housing 16 and preferably comprises an annular or circular frame 38 supported from a central hub 40 by means of a plurality of circumferentially spaced radially extending arms 42. The arms 42 and frame 38 preferably form an open-type planar area for supporting a transmission 44 within the interior of the tank or housing 16 during a transmission cleaning operation as will be hereinafter set forth. The hub member 40 may be journalled on a suitable spindle 46 in any suitable manner for rotation about the central axis thereof, and the spindle 46 may be secured to the bottom 18 of the housing 16 in any suitable manner, as is well known.

Figure 3:
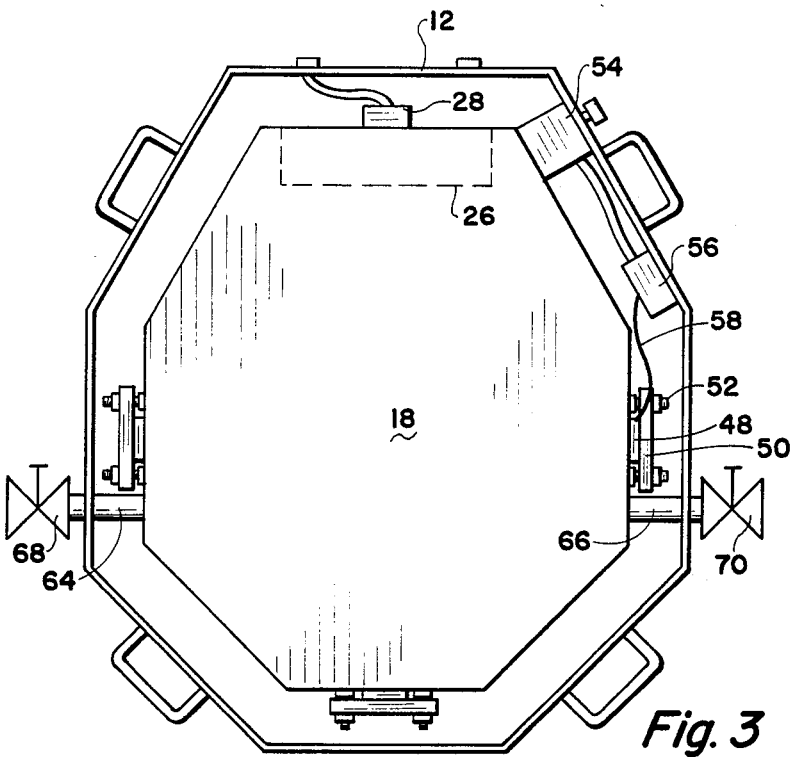
FIG. 3 is an enlarged bottom view of a transmission cleaning apparatus embodying the invention.

It will be apparent from an inspection of FIG. 3 that the housing 16 is of an elongated octangonal cross sectional or planar configuration providing a main housing portion wherein the rotatable support means 36 is mounted and an offset portion wherein the transducer means 26 is disposed.

Suitable heater means, such as a plurality of electrical strip heaters 48 are secured to the outer periphery of the housing 16 in any well known manner, such as by strap members 50 bolted to the housing 16 by suitable bolts 52, or the like. The heaters 48 are preferably disposed in spaced relation around the outer periphery of the housing 16 and may be connected with a source of power by suitable conduit means (not shown) as is well known. It is also preferable to provide a suitable thermostat means 54 mounted on the outer periphery of the housing 16 in any well known manner for operable connection with the heaters 48 through a suitable relay means 56 and conduit 58. In addition, suitable insulation (not shown) may be interposed between the housing 12 and 16, if desired, for isolating the heat of the inner housing 16 from the exterior housing 12. It is desirable to provide a plurality of caster assemblies 60 for facilitating portability or maneuvering of the apparatus 10. The caster assemblies 60 may be secured to the bottom portion of the housing 12 in any suitable manner for supporting the apparatus 10 on a floor 62, or the like.

Suitable oppositely disposed drain ports (not shown) are provided in the sidewalls of the housing 16 in the proximity of the bottom 18, with one of the drain ports being in communication with a conduit 64 and the other drain port being in communication with a conduit 66. Each conduit is preferably provided with a valve 68 and 70, respectively, interposed therein, for controlling the flow of fluid through the conduits. The conduits 64 and 66 are in communication with a reservoir (not shown) or other source (not shown) of cleaning liquid, which is a technically compounded blend of the proper chemicals to perform the transmission cleaning job, as is well known in general ultrasonic cleaning methods. In addition, at least one of the conduits, such as the conduit 64, is in communication with suitable filter pumping means (not shown) which may be utilized for circulating the cleaning liquid across the inner surface of the bottom 18 of the tank 16 to remove sludge and other debris which may accumulate during a transmission cleaning operation, as will be hereinafter set forth.

Figure 1:
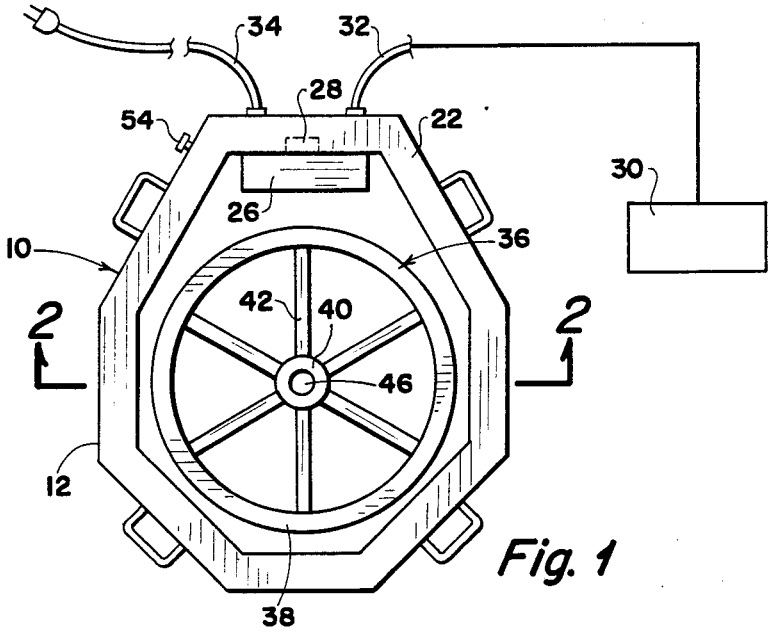
FIG. 1 is a top plan view of a transmission cleaning apparatus embodying the invention.

It has been found, as a practical matter, that efficient cleaning results are obtained if the object to be cleaned is disposed at a distance of approximately two inches from the face or output surface of the transducer means 26. As a consequence, it is preferable that the turntable or rotatable support means 36 be positioned with respect to the transducer 26 in such a manner that the outer periphery of the turntable passes across the face of the transducer 26 at a preselected distance as the turntable is rotated, as will be hereinafter set forth, and as particularly shown in FIG. 1.

In order to perform an ultrasonic cleaning operation on the transmission 44, the cleaning liquid (not shown) may be admitted into the interior of the tank or housing 16 in any suitable manner, such as through the open upper end 20 thereof. The cleaning solution or liquid is particularly selected in accordance with the material which is being cleaned, i.e. copper, brass, aluminum, plastic, steel, or the like, and is preferably a mild solution which is non-injurious to hands, skin, and the like, of the operator of the apparatus or equipment. Of course, it may be preferable to construct the tank 16, and any other parts of the apparatus 10 as desired, from stainless steel or other suitable corrosion restraint material for assuring a prolonged useful life for the apparatus 10.

Figure 4:
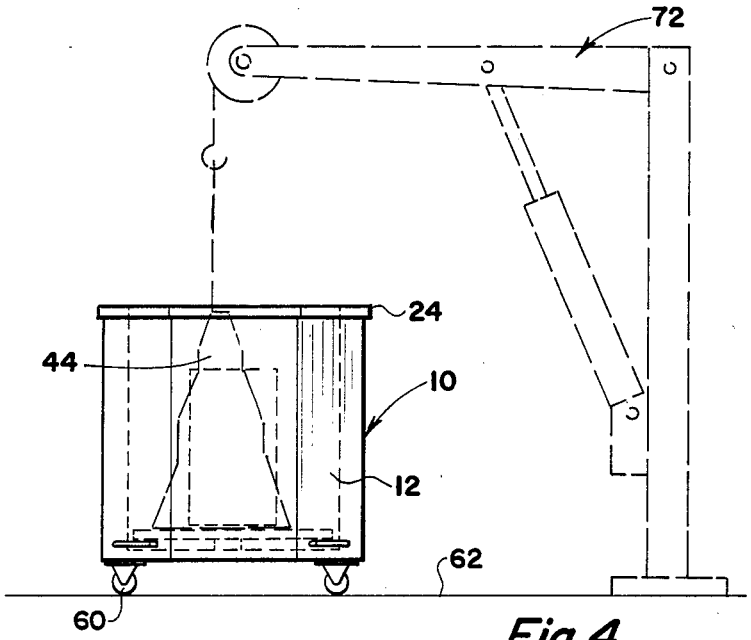
FIG. 4 is a side elevational view of a transmission cleaning apparatus embodying the invention and depicted in combination with a transmission being cleaned therein, with suitable hoisting equipment being shown in broken lines for purposes of illustration.

The heaters 48 may be activated in the usual manner for applying heat to the housing 16 and ultimately to the cleaning liquid housed therein. It is preferable that the temperature of the cleaning liquid be maintained between approximately 100° F. and 140° F., but not limited thereto. In addition, the transducer means 26 may be activated by the normal operation of the ultrasonic generator means 40 for agitation of the cleaning fluid to provide the cavitation effect hereinbefore set forth. The transmission 44 may then be immersed within the liquid bath or cavitated fluid in any suitable manner, such as by hoist and crane apparatus generally indicated at 72 and shown in broken lines in FIG. 4. The transmission is deposited within the interior of the tank 16 with one end of the transmission being supported by the turntable means 36. The turntable means 36 may then be rotated about the central axis of the hub means 40 in any suitable manner, such as by manual rotation of the transmission itself, or by means of a removable flexible cable means (not shown) operably connected with a power source or motor (not shown) and removably engagable with the transmission for transmitting rotation to the turntable means 36 and thus rotating the transmission within the housing 16. As the transmission 44 rotates simultaneously with the turntable means 36, the entire outer periphery or outer surfaces of the transmission are passed across the face or surface of the transducer means 26 at the prescribed or most desirable distance therefrom for achieving an efficient cleaning of the transmission, both exteriorly and interiorly.

The cleaned transmission may be removed from the cleaning liquid or liquid bath in any suitable manner, such as by the crane and hoisting apparatus 72, and upon drying of the cleaned transmission, and required repairs may be readily accomplished. The cleaned and repaired transmission (if such repairs are required) may be reinstalled in the vehicle, or other operational site wherein the transmission is to be utilized. No disassembly of the transmission is required for the cleaning operation, and thus no reassembly must be done during the cleaning operation or subsequent thereto.

It is to be noted that removable basket means (not shown) may be provided for insertion within and removal from the interior of the housing 16, if desired. Such as basket means may preferably be of an open-grid type construction whereby the cleaning liquid or liquid bath may freely flow through the basket. A plurality of transmission heads may be placed in the basket and lowered into the cleaning solution simultaneously. The basket may rest on the turntable means 26, and the transmission heads contained therein may be ultrasonically cleaned in the manner as hereinbefore set forth.

From the foregoing, it will be apparent that the present invention provides a novel method and means for the ultrasonic cleaning of automotive transmissions, and the like, wherein the transmission may be deposited within a liquid bath, rotated within the liquid bath for passing each and every exterior surface of the transmission across the face of a suitable transducer means at a preselected distance therefrom for simultaneously cleaning both the interior and exterior of the transmission without the necessity of disassembly and ultimate reassembly of the transmission.

Whereas the present invention has been described in particular relation to the drawings attached hereto it should be understood that other and further modifications, apart from those shown or suggested herein may be made within the spirit and scope of this invention.

What is claimed is:

1. Apparatus for ultrasonic cleaning of transmissions comprising housing means for receiving a suitable cleaning liquid therein and having an elongated octagonal cross sectional configuration providing a main portion and an offset portion for the housing and having a bottom with a central portion, transducer means having an output surface secured in the housing in the proximity of the offset portion thereof for selectively impressing ultrasonic energy on the cleaning liquid for cavitation thereof, ultrasonic generator means operably connected to the transducer means for activation thereof, heating means secured to the housing means for heating of the cleaning liquid, and rotatable support means disposed within the housing at the bottom thereof and in the main portion thereof and having its axis at said central portion of the bottom for supporting the transmission within the housing means and rotating the transmission so that the entire outer periphery of the transmission longitudinal of said axis is passed across the output surface of the transducer means at a preselected distance with respect thereto during the cleaning operation for simultaneously cleaning the interior and exterior of the transmission without disassembly thereof.

2. Apparatus for ultrasonic cleaning of transmissions as set forth in claim 1 and including thermostat means operably connected with the heating means for controlling the heating temperature of the cleaning liquid.

3. Apparatus for ultrasonic cleaning of transmissions as set forth in claim 1 wherein the housing means comprises an outer housing, an inner housing supported within the outer housing and concentrically arranged with respect thereto, the inner housing having an internal chamber for receiving the cleaning fluid therein.

4. Apparatus for ultrasonic cleaning of transmissions as set forth in claim 3 wherein the heating means is secured to the outer periphery of the inner housing.

5. Apparatus for ultrasonic cleaning of transmissions as set forth in claim 3 wherein the transducer means is secured to the inner housing.

6. Apparatus for ultrasonic cleaning of transmissions as set forth in claim 3 wherein the transducer means is secured to the inner periphery of the inner housing and is immersed in the cleaning liquid.

7. Apparatus for ultrasonic cleaning of transmissions as set forth in claim 1 wherein the heating means comprises a plurality of strip heaters secured to the inner housing in spaced relation around the outer periphery thereof.

8. Apparatus for ultrasonic cleaning of transmissions as set forth in claim 1 and including caster means secured to the housing means for facilitating portability of the apparatus.

9. A method of cleaning assembled transmissions comprising the steps of providing a reservoir of cleaning liquid, heating the cleaning liquid, impressing ultrasonic energy on the cleaning liquid from an output surface of an ultrasonic transducer to cavitate the cleaning liquid, immersing the assembled transmission in the cavitated cleaning liquid at an area spaced from the output surface of the ultrasonic transducer, rotating the transmission within the cavitated cleaning liquid about an axis so that the entire outer periphery of the transmission longitudinal of said axis is passed across the output surface of the ultrasonic transducer in preselected spaced relation with respect thereto whereby the interior and exterior of the transmission are simultaneously cleaned without disassembly of the transmission during the cleaning operation.

10. A method of cleaning transmissions as set forth in claim 9 and including the step of thermostatically monitoring the heating of the cleaning liquid.

* * * * *